US009600015B2

(12) United States Patent
Marinca

(10) Patent No.: US 9,600,015 B2
(45) Date of Patent: Mar. 21, 2017

(54) CIRCUIT AND METHOD FOR COMPENSATING FOR EARLY EFFECTS

(71) Applicant: Analog Devices Global, Hamilton (BM)

(72) Inventor: Stefan Marinca, Limerick (IE)

(73) Assignee: Analog Devices Global, Hamilton (BM)

( * ) Notice: Subject to any disclaimer, the term of this patent is extended or adjusted under 35 U.S.C. 154(b) by 0 days.

(21) Appl. No.: 14/531,541

(22) Filed: Nov. 3, 2014

(65) Prior Publication Data

US 2016/0126935 A1 May 5, 2016

(51) Int. Cl.
*G05F 3/30* (2006.01)

(52) U.S. Cl.
CPC ..... *G05F 3/30* (2013.01)

(58) Field of Classification Search
CPC ..... G05F 3/30; G05F 3/267
See application file for complete search history.

(56) References Cited

U.S. PATENT DOCUMENTS 5,814,995 A * 9/1998 Tasdighi ..... G01R 19/16542 324/431
6,137,341 A * 10/2000 Friedman ..... G05F 3/265 323/314
6,175,265 B1 * 1/2001 Ueno ..... G05F 3/225 323/315
6,194,886 B1 * 2/2001 D'Aquino ..... G05F 3/265 323/313
6,417,724 B1 * 7/2002 Taylor ..... G05F 3/245 327/512
6,426,669 B1 * 7/2002 Friedman ..... G05F 3/30 323/313
6,476,661 B1 * 11/2002 Iliasevitch ..... G05F 3/222 327/375
6,522,117 B1 * 2/2003 Young ..... G05F 3/267 323/315
7,012,416 B2 * 3/2006 Marinca ..... G05F 3/30 323/313
7,205,755 B2 * 4/2007 Ito ..... G05F 3/222 323/316
7,456,679 B2 * 11/2008 Pigott ..... G05F 3/30 323/313
7,598,799 B2 * 10/2009 Marinca ..... G05F 3/30 327/539
7,914,205 B2 * 3/2011 Galli ..... G01K 7/015 327/513
8,004,341 B1 * 8/2011 Gilbert ..... G06G 7/24 327/350
8,378,735 B2 * 2/2013 Pereira Da Silva, Jr. ..... G01K 7/01 327/512
8,710,901 B2 * 4/2014 Bibee ..... H03K 17/223 327/513
9,098,098 B2 * 8/2015 Shaeffer ..... G05F 3/02
2009/0224819 A1 * 9/2009 Shibata ..... G05F 3/30 327/513

(Continued)

*Primary Examiner* — Thomas J Hiltunen
(74) *Attorney, Agent, or Firm* — Schwegman Lundberg & Woessner, P.A.

(57) ABSTRACT

Early effects are intrinsically present in bipolar junction transistors (BJTs). Described are examples of complimentary to absolute temperature (CTAT) and proportional to absolute temperature (PTAT) cells that reduce errors associated with the Early effects that would otherwise be present.

27 Claims, 4 Drawing Sheets

(56) References Cited

U.S. PATENT DOCUMENTS

| | | | | |
|---|---|---|---|---|
| 2013/0038317 | A1* | 2/2013 | Marinca | G05F 3/30 323/313 |
| 2014/0117967 | A1* | 5/2014 | Mitsuishi | G05F 3/30 323/313 |
| 2015/0338872 | A1* | 11/2015 | Afzal | G05F 3/30 323/313 |

* cited by examiner

CIRCUIT AND METHOD FOR COMPENSATING FOR EARLY EFFECTS

FIELD OF THE INVENTION

The present disclosure relates to a method and apparatus for compensating for the Early effects that are intrinsically present in bipolar junction transistors (BJT). More particularly the present disclosure relates to a methodology and circuitry configured to reduce the nonlinearity arising from the base-emitter voltage difference that are proportional to absolute temperature (PTAT) as generated from two identical BJTs that are operating at different collector current densities. A circuit and method per the present teaching may advantageously be used in temperature sensors, bandgap type voltage references and different analog circuits.

BACKGROUND

A variation of the collector current ($I_c$) due to the variation of base-collector voltage and base-emitter voltage are called the Early effects. The Early effects are related to the modulations in the base width of the BJT arising from bias voltages applied to the collector-base junction and base-emitter junction. The direct or forward Early effect corresponds to the base width modulation due to the collector-base voltage variation and the reverse Early effect corresponds to the base width modulation due to the emitter-base voltage variation. The Early effects have particular effects in bandgap circuits which use two or more BJT to generate a voltage output. In such circuits, the impact of the direct and reverse Early voltages contribute to the overall output of the circuit as the output is a combination of the base emitter voltages plus a proportional to absolute voltages (PTAT) based on a base-emitter voltage difference of two bipolar transistors operating at different collector current density. This is more important in silicon based temperature sensors.

There continues to exist a need to compensate for the Early effect.

SUMMARY

Accordingly the present teaching provides a method and apparatus that compensates for the Early effect. The present teaching is based on an understanding that the Early effects that are intrinsically present in bipolar transistors can be compensated by judicious biasing of individual transistors. Using this understanding a complimentary to absolute temperature, CTAT, cell and a proportional to absolute temperature, PTAT cell can be generated whose output is unaffected by the Early effect. By combining outputs from each of these two cells it is possible to generate a reference circuit whose output is at least to a first order temperature insensitive.

These and other features will be better understood with reference to the following drawings which provide the person of skill with an understanding of the present teaching but in no way is intended to limit the present teaching to the specifics that follow.

DETAILED DESCRIPTION OF THE DRAWINGS

Figure 1:
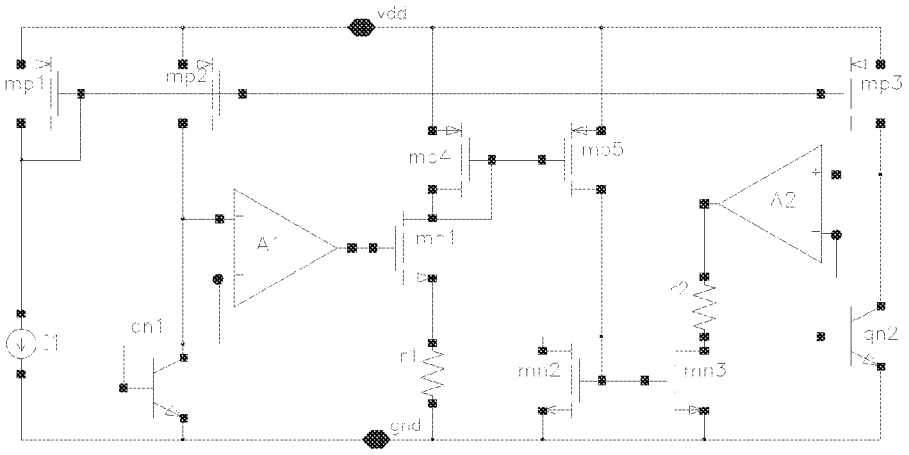
FIG. 1 is an example of a circuit that is implemented in accordance with the present teaching.

In order to appreciate the present teaching and how it addresses errors introduced by the Early effect it is appropriate to consider how the transistor actually functions. Mathematical models of a bipolar junction transistor exist and one such model is the Gummel-Poon model which details:

$$I_c = I_s\left(e^{\frac{V_{BE}}{V_T}} - e^{\frac{V_{BC}}{V_T}}\right) * \left(1 - \frac{V_{BE}}{V_{AR}} - \frac{V_{BC}}{V_{AF}}\right) \tag{1}$$

where:

$I_C$ is the collector current;

$I_S$ is the saturation current;

$V_{BE}$ is the base-emitter voltage;

$V_{BC}$ is the base-collector voltage;

$V_{AF}$ is the direct Early voltage parameter $V_{AR}$ is the reverse Early voltage parameter;

$V_T$ is the thermal voltage, $$V_T = \frac{kT}{q}$$

with k, Boltzmann's constant, T, absolute temperature and q the charge of one electron.

In normal transistor operation, an emitter-base junction is forward biased and the collector-base junction is reverse biased such that eq. (1) can be re-written as:

$$I_c = I_s\left(e^{\frac{V_{BE}}{V_T}} - e^{\frac{V_{BC}}{V_T}}\right) * \left(1 - \frac{V_{BE}}{V_{AR}} - \frac{V_{BC}}{V_{AF}}\right) \cong I_s e^{\frac{V_{BE}}{V_T}} * \left(1 - \frac{V_{BE}}{V_{AR}} + \frac{V_{CB}}{V_{AF}}\right) \tag{2}$$

From equation (2) it is possible to derive the relationship:

$$e^{\frac{V_{BE}}{V_T}} = \frac{I_c}{I_s * \left(1 - \frac{V_{BE}}{V_{AR}} + \frac{V_{CB}}{V_{AF}}\right)} \tag{3}$$

The base-emitter voltage can now be expressed in terms of the thermal voltage, $V_T$, collector current, $I_C$, saturation current $I_S$ and Early voltage parameters, $V_{AF}$ and $V_{AR}$:

$$V_{BE} = V_T \ln\frac{I_c}{I_s} - V_T \ln\left(1 - \frac{V_{BE}}{V_{AR}} + \frac{V_{CB}}{V_{AF}}\right) = V'_{BE} - V_T \ln\left(1 - \frac{V'_{BE}}{V_{AR}} + \frac{V_{CB}}{V_{AF}}\right) \tag{4}$$

In equation (4) $V'_{BE}$ represents the base-emitter voltage that are unaffected by Early effects. For collector current that are proportional to absolute temperature, PTAT collector currents, the V'BE voltage is temperature dependent according to equations (2) and (5) such that:

$$V'_{BE}(T) = V_{G0} - \frac{T}{T_0}[V_{G0} - V_{be0}] - (XTI - 1)\frac{kT}{q}\left[\ln\left(\frac{T}{T_0}\right)\right] \quad (5)$$

It will be appreciated that for any given collector current, the base-emitter voltage is as it is and cannot be modified. The present inventor has realized however that the collector-base voltage can be adjusted such that the direct and reverse Early effects compensate each other. Using an analysis derived from the relationship defined in equation (4), the compensation condition is:

$$V_{CB} = V_{BE} * \frac{V_{AF}}{V_{AR}} \quad (6)$$

If equation (6) is satisfied then the base-emitter voltage temperature dependency of a single transistor can be determined as unaffected by Early effects. FIG. 1 shows an example of a circuit that biases the collector of a single bipolar transistor, qn2, with a scaled base emitter voltage to compensate for the Early effect of the single transistor. In this implementation the forward and reverse Early effects are compensated for the single transistor such that this circuit can be used to generate a base emitter voltage, $V_{BE}$, that has no Early effect contribution. Such a voltage has characteristics that are complimentary to absolute temperature, CTAT, and can therefore be usefully used as a temperature sensor or incorporated with other circuits with proportional to absolute temperature, PTAT, characteristics to generate a voltage reference circuit whose output is independent of temperature.

While there are many ways to generate the scaled CTAT voltage that is used to bias the collector of qn2 to compensate for the Early effect, FIG. 1 provides an example. In this circuit a first bipolar transistor, qn1, is used to generate a CTAT voltage component that mirrored and scaled by a ratio of two resistors, r2/r1, and then used to bias the collector of a second bipolar transistor, qn2. In this circuit, a bias current, I1, which is preferably PTAT in form, is mirrored from a diode connected PMOS transistor mp1 to similar PMOS transistors mp2 and mp3 which are configured to act as current mirrors. The drain current of the PMOS transistor mp2 is used to bias a first bipolar transistor qn1. A first amplifier, A1, controls the gate node of NMOS transistor mn1 such that the base-emitter voltage of qn1 which is CTAT in form and has a contribution from the reverse Early effect, is reflected across a first resistor, r1. The drain current of the NMOS mn1 is reflected from the diode connected PMOS transistor mp4 to the drain of a similarly arranged PMOS transistor mp5. This, in turn, is mirrored from a diode connected NMOS transistor mn2 to a similarly configured NMOS transistor mn3. Assuming that the circuit of FIG. 1 is biased from a dc voltage connected from vdd to gnd nodes and assuming that mp4 and mp5 have the same aspect ratio (WA) and also mn2 and mn3 have the same aspect ratio, the drain current of mn3 can be determined from the following relationship:

$$I(mn3, d) = \frac{V_{BE}(qn1)}{r_1} \quad (7)$$

where $V_{BE}$ (qn1) represents the base-emitter voltage of qn1.

The current mirror MOS transistor mp3 generates the collector current for the second bipolar junction transistor (BJT), qn2 which has a direct Early effect error contribution. This transistor is also coupled to the non-inverting node and output of a second amplifier A2. The output of this amplifier is coupled by a second resistor, r2 of the circuit to the base of the second BJT, qn2. The values of the mp3 drain current and the value of the second resistor r2 set the collector-base voltage of qn2 to the value:

$$V_{CB}(qn2) = I(mn3, d) * r_2 = V_{BE}(qn1) * \frac{r_2}{r_1} \quad (8)$$

By judiciously scaling the values of the first and second resistors r2 and r1 it is possible to provide a relationship between the forward and reverse Early Effect per equation (9) below:

$$\frac{r_2}{r_1} = \frac{V_{AF}}{V_{AR}} \quad (9)$$

In this way the Early effects of the base-emitter voltage of the second bipolar qn2 are completely eliminated and the base-emitter voltage of transistor qn2 which is CTAT in form can be determined in accordance with the values of equation (5) above. In effect, the direct Early effect associated with the bipolar transistor qn2 is used to compensate for the reverse Early effect of the same transistor by properly biasing its collector-base junction. It will be appreciated from an examination of typical values associated with base-emitter voltages and operation of transistors at ambient temperatures that practical values for the terms in the above equation are: Vbe=0.7V; $V_{AF}$=50V; $V_{AR}$=5V, ΔVbe=0.054V. Using these numbers it will be appreciated that a circuit per the teaching of FIG. 1 would require a collector-base voltage of 0.7*50/5=7V to negate the Early effect. For many circuit implementations this may not be practical but as this circuit provides complete compensation of the reverse and forward Early effects for a single transistor it provides a very useful CTAT cell that can be used in other circuits such as those described above for use for example as a temperature sensor or a component circuit cell of a temperature independent voltage reference.

The present inventor has also realized that it is possible to generate a PTAT cell which is also is compensated for the Early effect. Such a PTAT cell can also be used as a temperature sensor or as a component circuit cell of a temperature independent voltage reference.

It will further be appreciated from a close examination of the terms of equation (5) that there are sources of non-linearity. The nonlinearity of the base-emitter voltage difference, $\Delta V_{BE}$ which is intrinsically PTAT in form, can be reduced close to un-measurable levels if this voltage is extracted from the two bipolar transistors qn1, qn2 that are biased differently. Specifically, if the low current density bipolar transistor is biased with a zero collector-base voltage, and the high collector current density bipolar transistor is biased with a PTAT voltage, for a first approximation we can reduce close to zero the non-linearity of the base-emitter voltage difference. The base-emitter voltages of the two bipolar transistors operating at different collector current densities can be expressed in terms of equations (10) and (11):

$$V_{BE1}(T) = a - b\frac{T}{T_0} + c\frac{T}{T_0} \tag{10}$$

$$V_{BE2}(T) = a - b\frac{T}{T_0} \tag{11}$$

where $V_{BE1}(T)$ represents the base-emitter voltage of the high collector current density transistor, a is extrapolated bandgap voltage, $V_{BE2}$ (T) represents the base-emitter voltage of the low collector current density transistor and $$c\frac{T}{T_0}$$

represents the base-emitter voltage difference (c corresponds to the base-emitter voltage difference at temperature $T_0$).

If the low current density bipolar transistor is virtually diode connected (with zero collector-base voltage) and the high current density bipolar transistor has a collector-base voltage $V_{CB}$ the two nonlinearities of their base-emitter voltages are:

$$V_{nl1} = -V_T \ln\left(1 - \frac{a - b\frac{T}{T_0} + c\frac{T}{T_0}}{V_{AR}} + \frac{V_{CB}}{V_{AF}}\right) \tag{12}$$

$$V_{nl2} = -V_T \ln\left(1 - \frac{a - b\frac{T}{T_0}}{V_{AR}}\right) \tag{13}$$

The nonlinearity of the base-emitter voltage difference corresponds to the difference of the two nonlinearities:

$$\Delta V_{nl} = V_{nel1} - V_{nel2} = -V_T \ln\frac{1 - \frac{a - b\frac{T}{T_0} + c\frac{T}{T_0}}{V_{AR}} + \frac{V_{CB}}{V_{AF}}}{1 - \frac{a - b\frac{T}{T_0}}{V_{AR}}} = -V_T \ln\left(1 - \frac{\frac{c\frac{T}{T_0}}{V_{AR}} - \frac{V_{CB}}{V_{AF}}}{1 - \frac{a - b\frac{T}{T_0}}{V_{AR}}}\right) \tag{14}$$

This difference can be set to zero for:

$$V_{CB} = \frac{V_{AF}}{V_{AR}} * c\frac{T}{T_0} \tag{15}$$

In order to compensate the nonlinearity of the base-emitter voltage difference the collector-base voltage of the higher collector current density bipolar transistor has to be PTAT, of the form:

$$V_{CB}(T) = V_{CB0}\frac{T}{T_0} \tag{16}$$

where $V_{CB0}$ represents the collector-base voltage at reference temperature $T_0$.

From equations (15) and (16) we get:

$$V_{CB0} = \frac{V_{AF}}{V_{AR}} * c \tag{17}$$

Figure 2:
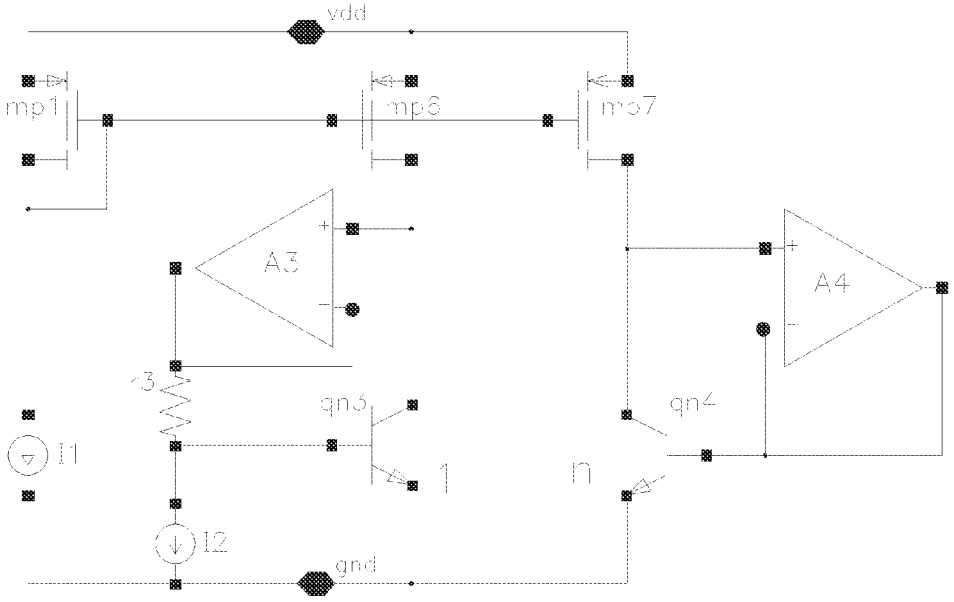
FIG. 2 is an example of another circuit that is implemented in accordance with the present teaching.

An example of a circuit which is configured to implement such compensation and provide a PTAT cell is presented in FIG. 2. As will become clear from the following in such an implementation and using the same typical values for ambient temperature operation that was discussed with respect to FIG. 1, a PTAT collector-base voltage with the value of (50/5)*0.054=0.54V at ambient temperature is required to compensate for the nonlinearity of the base-emitter voltage difference. It will be appreciated that this is much more feasible to provide for most circuit implementations. In this circuit, first and second bipolar transistors, each of which have intrinsic Early effects associated with them, are judiciously combined such that the difference in their base-emitter voltages, the $\Delta V_{BE}$, is compensated for the Early effect.

As in the circuit of FIG. 1, a bias current I1 is mirrored via PMOS devices mp1, mp6 and mp7 to collectors of a first bipolar transistor qn3 and a second bipolar transistor qn4. The first bipolar transistor is configured to operate with a higher collector current density than the second bipolar transistor qn4. A non-inverting node of a first amplifier A3 is coupled to the collector of the first bipolar transistor qn3. The output of the first amplifier A3 is also coupled via a resistor r3 to the base of the first bipolar transistor. A non-inverting node of a second amplifier A4 is coupled to PMOS device mp7 and also to the second bipolar transistor qn4. In this way each of the first and second bipolar transistors are biased from the same bias current I1. The first bipolar transistor is affected by both the direct and the reverse Early effects.

A second bias current I2, having a PTAT form, is also coupled to the resistor r3 and generates a PTAT voltage across the resistor r3. The amplifier A3 is provided with its input nodes at the same potential such that the PTAT voltage drop across r3 is translated as a collector-base voltage of the first bipolar transistor qn3. The amplifier A4 forces the second bipolar transistor qn4 to operate with zero collector-base voltage, such that the second bipolar transistor it is only affected by the reverse Early effect. The voltage difference from the base node of qn3 to the base node of qn4 can be configured to be very linear with absolute temperature if the collector-base voltage of qn3 is set according to the relationship defined in equation (17). By knowing the two model parameters $V_{AR}$ and $V_{AF}$ and the constant c the collector-base voltage of qn3 can be imposed such that Eq. 17 is satisfied and the nonlinearity of the base-emitter voltage difference is zero. It will be appreciated that in this circuit while each of the first and second bipolar transistors are independently affected by the Early effects, by judiciously arranging the circuit elements relative to one another, the overall base emitter voltage difference of the first and second bipolar transistors is not affected by the Early effects.

A circuit according to FIG. 2 in low geometry BiCMOS process was simulated. The Early voltage parameters of the bipolar transistor models are: $V_{AF}$=52.2V and $V_{AR}$=5.89V; qn3 is a unity device of 5 um×5 um emitter area; qn4 consists of eight similar transistors connected in parallel; the collector currents of qn3 and qn4 are set as PTAT of 3 uA at $T_0$=300K (26.85° C.). In order to eliminate the nonlinearity of the base-emitter voltage difference from hand calculation we need:

$$V_{CB0} = \frac{V_{AF}}{V_{AR}} * c = \frac{52.2}{5.89} * 0.054 \text{ V} = 0.478 \text{ V} \tag{18}$$

In order to calculate the deviation of the simulated PTAT voltage from the ideal value a PTAT voltage is defined as:

$$V_{PTAT} = \Delta Vbe(T_0 = 300 \text{ K}) * \frac{tdegc + 26.85}{300} \tag{19}$$

Here $\Delta$Vbe($T_0$=300K) represents the simulated base-emitter voltage difference such that the two voltages, simulated and ideal, have the same value at $T_0$=300K.

Two simulations were performed: the first with qn3 and qn4 having zero collector-base voltages, according to the prior art circuits, and second with qn3 having a PTAT collector-base voltage of 0.478V and qn4 with zero collector-base voltage.

Figure 3:
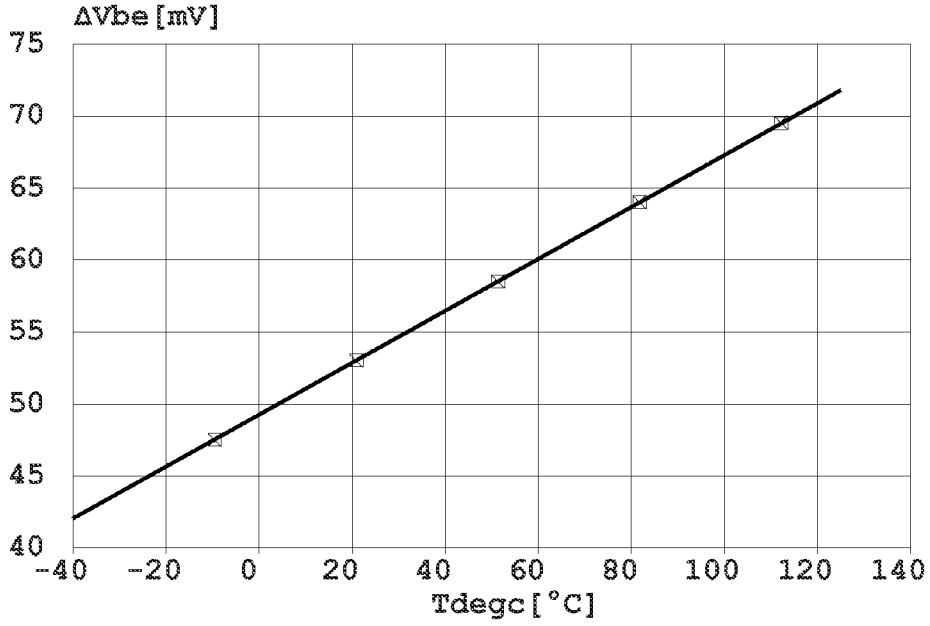
FIG. 3 shows simulation results with base-emitter voltage difference for a prior art circuit and an ideal PTAT voltage.
Figure 4:
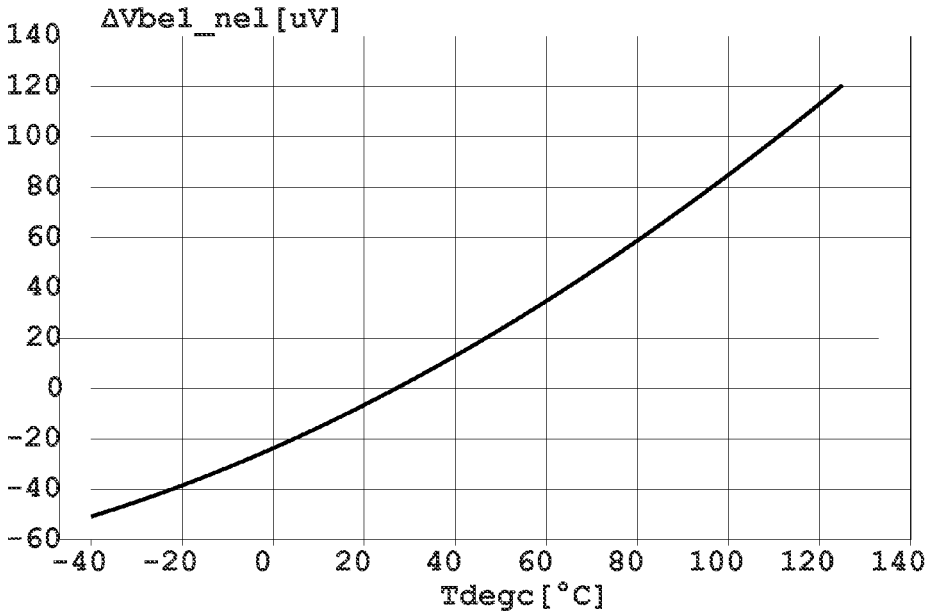
FIG. 4 shows results the voltage non-ideality representing the difference of the two voltages components plotted in FIG. 3.

The first simulation results (base-emitter voltage and ideal PTAT voltage) for temperature ranging from −40° C. to 125° C. are plotted in FIG. 3. As FIG. 3 shows the two voltages appear to be very close. Their common value at 26.85° C. is $\Delta$Vbe=54 mV. This corresponds to a temperature sensitivity of ~180 uV/° C. In reality there is quite a large difference and nonlinearity from the ideal PTAT voltage to the simulated base-emitter voltage difference, illustrated in FIG. 4. This voltage difference is about 170 uV, close to 1° C. in a temperature range from −40° C. to 125° C.

Figure 5:
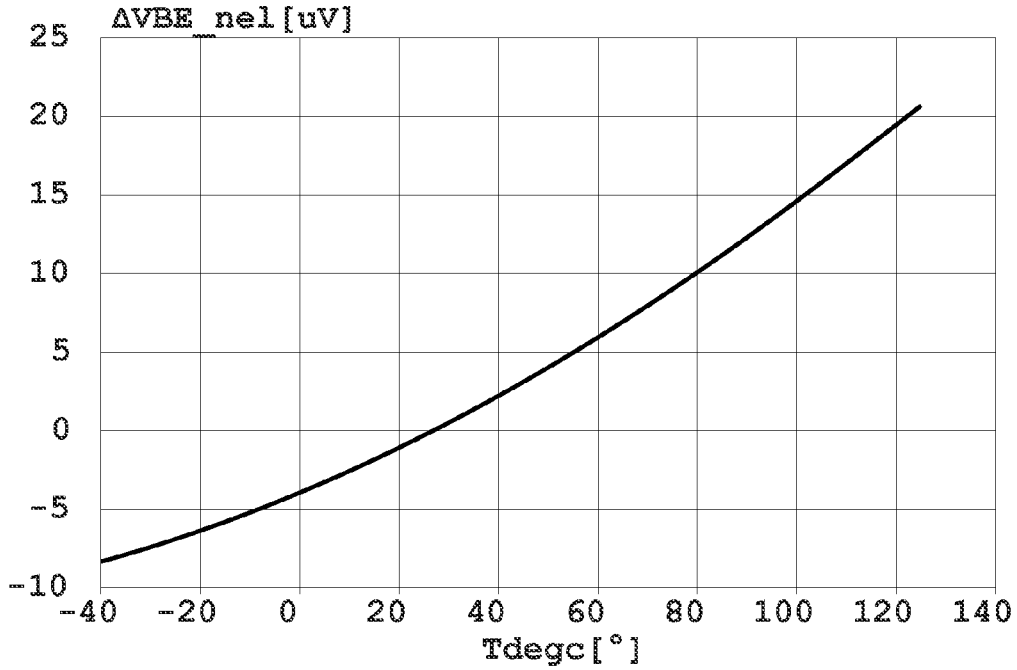
FIG. 5 shows a simulation plot of a voltage difference for the circuit of FIG. 2.

The same voltage difference for qn3 having $V_{CB0}$=0.478V (at 26.85° C.) is presented in FIG. 5. The corresponding deviation is about 30 uV, or 0.16° C. As will be appreciated these results are only an approximation as the base-emitter voltages were reduced in accordance with the parameters determined from equations (10) and (11).

Figure 6:
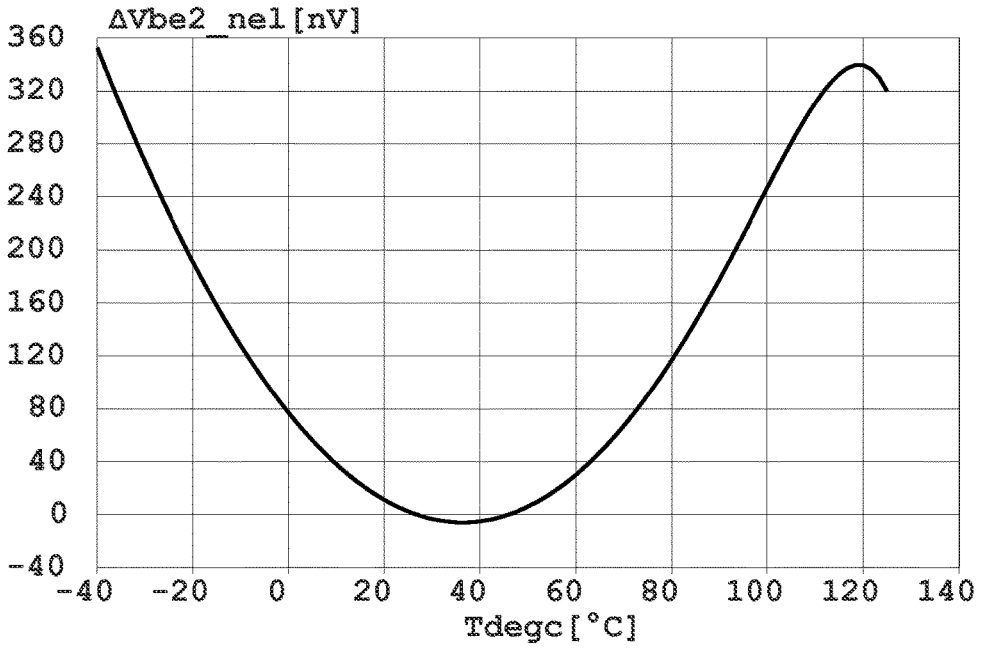
FIG. 6 shows simulation results for an optimized circuit implemented in accordance with the present teaching.

A final simulation was performed with optimum base-collector voltage of 0.577V. The corresponding voltage difference is presented in FIG. 6. The maximum deviation is 0.36 uV or 0.002° C., which is more than four hundreds improvements compared to the situation with the bipolar transistors diode connected per the prior art implementation.

Figure 7:
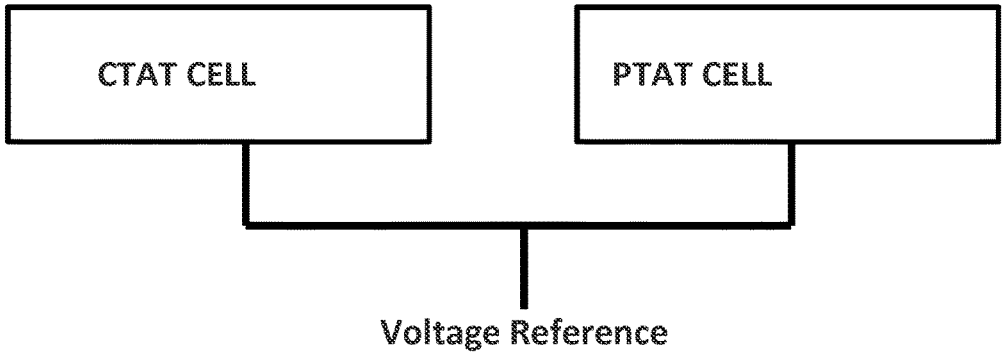
FIG. 7 is a schematic showing how a CTAT cell can be combined with a PTAT cell to provide a voltage reference.

It will be appreciated that circuits provided in accordance with the present teaching provide a number of advantages which are derived from reducing error contributions derived from the Early effects. By obviating any contribution from the Early effects, a high precision CTAT or PTAT voltage can be generated. If a high precision CTAT cell is coupled to a high precision PTAT cell then a temperature independent voltage reference can be implemented. FIG. 7 shows in high level architecture how such a voltage reference can be provided.

It is however not intended to limit the present teaching to any one set of advantages or features as modifications can be made without departing from the spirit and or scope of the present teaching.

The systems, apparatus, and methods of providing a voltage output which is not affected by the Early effects are described above with reference to certain embodiments and a circuit provided in accordance with the present teaching can be used for providing a current or voltage reference.

Additionally, while the base-emitter voltages have been described with reference to the use of specific types of bipolar transistors any other suitable transistor or transistors capable of providing base-emitter voltages could equally be used within the context of the present teaching. It is envisaged that each single described transistor may be implemented as a plurality of transistors the base-emitters of which would be connected in parallel. It will be further appreciated that transistors described herein have all 3 terminals available and as modern CMOS processes have deep N-well capabilities it is possible to use these processes fabricate low quality, but functional vertical npn bipolar transistors.

Such systems, apparatus, and/or methods can be implemented in various electronic devices. Examples of the electronic devices can include, but are not limited to, consumer electronic products, parts of the consumer electronic products, electronic test equipment, wireless communications infrastructure, etc. Examples of the electronic devices can also include circuits of optical networks or other communication networks, and disk driver circuits. The consumer electronic products can include, but are not limited to, measurement instruments, medical devices, wireless devices, a mobile phone (for example, a smart phone), cellular base stations, a telephone, a television, a computer monitor, a computer, a hand-held computer, a tablet computer, a personal digital assistant (PDA), a microwave, a refrigerator, a stereo system, a cassette recorder or player, a DVD player, a CD player, a digital video recorder (DVR), a VCR, an MP3 player, a radio, a camcorder, a camera, a digital camera, a portable memory chip, a washer, a dryer, a washer/dryer, a copier, a facsimile machine, a scanner, a multi-functional peripheral device, a wrist watch, a clock, etc. Further, the electronic device can include unfinished products.

Unless the context clearly requires otherwise, throughout the description and the claims, the words "comprise," "comprising," "include," "including," and the like are to be construed in an inclusive sense, as opposed to an exclusive or exhaustive sense; that is to say, in the sense of "including, but not limited to." The words "coupled" or "connected", as generally used herein, refer to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words using the singular or plural number may also include the plural or singular number, respectively. The words "or" in reference to a list of two or more items, is intended to cover all of the following interpretations of the word: any of the items in the list, all of the items in the list, and any combination of the items in the list. All numerical values provided herein are intended to include similar values within a measurement error.

The teachings of the inventions provided herein can be applied to other systems, not necessarily the circuits described above. The elements and acts of the various embodiments described above can be combined to provide further embodiments. The act of the methods discussed herein can be performed in any order as appropriate. Moreover, the acts of the methods discussed herein can be performed serially or in parallel, as appropriate.

While certain embodiments of the inventions have been described, these embodiments have been presented by way of example only, and are not intended to limit the scope of the disclosure. Indeed, the novel methods and circuits described herein may be embodied in a variety of other forms. Furthermore, various omissions, substitutions and changes in the form of the methods and circuits described herein may be made without departing from the spirit of the disclosure. The accompanying claims and their equivalents are intended to cover such forms or modifications as would fall within the scope and spirit of the disclosure. Accordingly, the scope of the present inventions is defined by reference to the claims.

The invention claimed is:

1. A complimentary to absolute temperature, CTAT, cell, the cell comprising:

a first bipolar transistor having a collector, base and emitter, a CTAT voltage generator coupled to the collector of the first bipolar transistor to bias the collector with a CTAT voltage and compensate the first bipolar transistor for the Early effect;

wherein the CTAT voltage generator comprises a second bipolar transistor of the cell, the second bipolar transistor coupled to the collector of the first bipolar transistor such that collector of the first bipolar transistor is biased with a voltage related to the base emitter voltage of the second bipolar transistor; and a current mirror, the current mirror mirroring a current generated by the second bipolar transistor across a resistor provided at the collector of the first bipolar transistor to bias the collector of the first bipolar transistor with the voltage related to the base emitter voltage of the second bipolar transistor.

2. The CTAT cell of claim 1 comprising a first amplifier and a second amplifier, an input of the second amplifier being coupled to the second bipolar transistor and an input and an output of the first amplifier being coupled to the first bipolar transistor.

3. The CTAT cell of claim 2 wherein the second amplifier and current mirror are configured to reflect a base emitter voltage of the second bipolar transistor across a first resistor, r1, the output of the first amplifier being coupled via a second resistor, r2, to the base of the first bipolar transistor and wherein the values of the first and second resistors are scaled relative to one another provide a relationship between the forward and revert Early effect in accordance with:

$$\frac{r_2}{r_1} = \frac{V_{AF}}{V_{AR}}$$

Where:

$V_{AF}$ is the direct Early effect voltage of the second bipolar transistor; and $V_{BF}$ is the reverse Early effect voltage of the second bipolar transistor;

such that the Early effects of the base-emitter voltage of the first bipolar transistor are completely eliminated.

4. The circuit of claim 3 wherein the collector-base junction of the second bipolar transistor is biased such that the direct Early effect associated with the second bipolar transistor qn2 is used to compensate for the reverse Early effect of the same transistor.

5. A proportional to absolute temperature, PTAT, cell, the cell comprising:

a first bipolar transistor and a second bipolar transistor, the first bipolar transistor configured to operate with a higher collector current density than the second bipolar transistor, each of the first bipolar transistor and the second bipolar transistor having a base, collector and emitter;

a first bias current source coupled to the collector of each of the first bipolar transistor and the second bipolar transistor;

a second bias current source providing a current having a form which is proportional to absolute temperature and coupled to a first resistor to generate a proportional to absolute temperature voltage drop across the first resistor, the voltage drop across the transistor operably being translated as a collector-base voltage of the first bipolar transistor;

wherein the second bipolar transistor is diode connected so as to be unaffected by the direct Early effect and the first bipolar transistor has contributions from each of the direct Early effect and the reverse Early effect, the first and second bipolar transistors being coupled to one another to operably generate a base emitter voltage difference which is unaffected by the Early effects.

6. The PTAT cell of claim 5 comprising:

a first amplifier and a second amplifier, an input of the first amplifier being coupled to the first bipolar transistor and an input and an output of the second amplifier being coupled to the second bipolar transistor;

a current mirror configured to provide the first bias current to collectors of each of the first bipolar transistor and the second bipolar transistor; and wherein the first bipolar transistor is configured to have a collector base voltage having a form which is proportional to absolute temperature, PTAT, and the second bipolar transistor is configured to operate with a zero-collector base voltage.

7. The PTAT cell of claim 6 wherein:

a non-inverting node of the first amplifier is coupled to the collector of the first bipolar transistor and the output of the first amplifier is coupled via the first resistor to the base of the first bipolar transistor; and a non-inverting node of the second amplifier is coupled to the second bipolar transistor.

8. The PTAT cell of claim 7 wherein:

the first amplifier is provided with its input nodes at the same potential such that the PTAT voltage drop across the first resistor is translated as a collector-base voltage of the first bipolar transistor.

9. The PTAT cell of claim 6 wherein the second amplifier is coupled to the second bipolar transistor and operably biases the second bipolar transistor to operate with zero collector-base voltage.

10. The PTAT cell of claim 5 configured such that a voltage difference between the base of the first bipolar transistor and the base of the second bipolar transistor is linear with absolute temperature, the collector base voltage of the first bipolar transistor being determined from the relationship:

$$V_{CB0} = \frac{V_{AF}}{V_{AR}} * c$$

Where $V_{CBO}$ is the collector base voltage of the first bipolar transistor;

$V_{AF}$ is the forward Early effect voltage of the second bipolar transistor;

$V_{AR}$ is the reverse Early effect voltage of the second bipolar transistor; and c corresponds to the base-emitter voltage difference of the second bipolar transistor at temperature $T_0$.

11. A voltage reference circuit comprising a complimentary to absolute temperature, CTAT, cell and a proportional to absolute temperature, PTAT, cell, the circuit being configured to combine an output from the CTAT cell with an output from the PTAT cell to generate a voltage reference which is first order insensitive to temperature variations, and wherein:

the CTAT cell comprises a first bipolar transistor having a collector, base and emitter, a CTAT voltage generator coupled to the collector of the first bipolar transistor to bias the collector with a CTAT voltage and compensate the first bipolar transistor for the Early effect; and the PTAT cell comprises:

a third bipolar transistor and a fourth bipolar transistor, the third bipolar transistor configured to operate with a higher collector current density than the fourth bipolar transistor, each of the third bipolar transistor and the fourth bipolar transistor having a base, collector and emitter;

a first bias current source coupled to the collector of each of the third bipolar transistor and the fourth bipolar transistor;

a second bias current source providing a current having a form which is proportional to absolute temperature and coupled to a first resistor to generate a proportional to absolute temperature voltage drop across the first resistor, the voltage drop across the transistor operably being translated as a collector-base voltage of the third bipolar transistor; and wherein the second bipolar transistor is diode connected so as to be unaffected by the direct Early effect and the first bipolar transistor has contributions from each of the direct Early effect and the reverse Early effect, the first and second bipolar transistors being coupled to one another to operably generate a base emitter voltage difference which is unaffected by the Early effects.

12. A method of generating an output which is proportional to absolute temperature, the method comprising:

providing a first bipolar transistor and a second bipolar transistor, the first bipolar transistor configured to operate with a higher collector current density than the second bipolar transistor, each of the first bipolar transistor and the second bipolar transistor having a base, collector and emitter;

providing a first bias current source coupled to the collector of each of the first bipolar transistor and the second bipolar transistor;

providing a second bias current source providing a current having a form which is proportional to absolute temperature and coupled to a first resistor to generate a proportional to absolute temperature voltage drop across the first resistor, the voltage drop across the transistor operably being translated as a collector-base voltage of the first bipolar transistor;

diode connecting the second bipolar transistor such that it is unaffected by the direct Early effect and the first bipolar transistor has contributions from each of the direct Early effect and the reverse Early effect, and coupling the first and second bipolar transistors to one another to operably generate a base emitter voltage difference which is unaffected by the Early effects.

13. The method of claim 12 comprising:

providing a first amplifier and a second amplifier, and coupling an input of the first amplifier to the first bipolar transistor and an input and an output of the second amplifier to the second bipolar transistor;

using a current mirror to provide the first bias current to collectors of each of the first bipolar transistor and the second bipolar transistor; and configuring the first bipolar transistor to have a collector base voltage having a form which is proportional to absolute temperature, PTAT, and the second bipolar transistor to operate with a zero-collector base voltage.

14. The method of claim 13 comprising using the second amplifier to operably bias the second bipolar transistor to operate with zero collector-base voltage.

15. The method of claim 12 comprising providing a first amplifier and a second amplifier, an input of the second amplifier being coupled to the second bipolar transistor and an input and an output of the first amplifier being coupled to the first bipolar transistor.

16. A method of generating an output which is complimentary to absolute temperature, CTAT, in form, the method comprising:

providing a first bipolar transistor having a collector, base and emitter;

providing a CTAT voltage generator coupled to the collector of the first bipolar transistor to bias the collector with a CTAT voltage and compensate the first bipolar transistor for the Early effect;

coupling a second bipolar transistor of the cell to the collector of the first bipolar transistor such that collector of the first bipolar transistor is biased with a voltage related to the base emitter voltage of the second bipolar transistor; and mirroring a current generated by the second bipolar transistor, using a current mirror of the cell, across a resistor provided at the collector of the first bipolar transistor to bias the collector of the first bipolar transistor with the voltage related to the base emitter voltage of the second bipolar transistor.

17. A temperature sensor circuit, comprising:

first and second bipolar transistors, each having respective base, collector, and emitter terminals, the first and second bipolar transistors configured to be biased with different collector current densities, the first and second bipolar transistors producing a temperature-dependent output voltage from a difference generated between the base-emitter voltages of the first and second bipolar transistors;

the first bipolar transistor including base and collector terminals configured to be biased at a specified non-zero proportional-to-absolute temperature offset voltage;

the second bipolar transistor including base and collector terminals configured to be biased at the same voltage; and wherein the first and second bipolar transistors are diode-connected using a respective active amplifier circuit in a path between the base and collector of each of the first and second bipolar transistors.

18. The temperature sensor circuit of claim 17, wherein the output voltage is compensated by cancelling forward and reverse Early effects by the selection of the specified value of the offset voltage.

19. The temperature sensor circuit of claim 18, wherein the first bipolar transistor is biased at a higher collector current density than the second bipolar transistor.

20. The temperature sensor circuit of claim 17, wherein the emitters of the first and second bipolar transistors are biased at the same voltage.

21. The temperature sensor circuit of claim 17, wherein the first bipolar transistor includes, in the path between the base and the collector of the first bipolar transistor, a resistor biased with a PTAT current in series with the active amplifier circuit, in a voltage follower configuration with an inverting terminal of the amplifier circuit connected to an output of the amplifier circuit.

22. A circuit comprising:

a first bipolar junction transistor (BJT) having a base shorted to a collector;

a second BJT having a emitter coupled to an emitter of the first BJT;

a resistor coupled between a base of the second BJT and a collector of the second BJT;

wherein a difference between the base-emitter voltage of the first BJT and a base-emitter voltage of the second BJT is configured to provide a proportional-to-absolute temperature (PTAT) voltage; and wherein the resistor is configured to compensate for Early effect induced non-linearity of the first and second BJTs within a range of PTAT voltage.

23. The circuit of claim 22, wherein the first BJT has a zero collector-base voltage to remove direct early effects associated with the first BJT.

24. The circuit of claim 23, including a first amplifier configured to short the base of the first BJT to the collector of the first BJT.

25. The circuit of claim 24, including a second amplifier having a first input coupled to the collector of the second BJT; and wherein the resistor is coupled to a second input of the second amplifier and to an output of the second amplifier.

26. The circuit of claim 22, wherein the first bipolar transistor is biased at a lower collector current density than the second bipolar transistor.

27. The circuit of claim 22, including a current mirror configured to bias the first BJT and the second BJT.

* * * * *